US009198514B2

(12) United States Patent
Machael et al.

(10) Patent No.: US 9,198,514 B2
(45) Date of Patent: Dec. 1, 2015

(54) CHAIR WITH PIVOT FUNCTION AND METHOD OF MAKING

(75) Inventors: Jay R. Machael, Muscatine, IA (US); Evan T. Aschbrenner, Muscatine, IA (US); Daniel W. Tracy, Jr., Muscatine, IA (US); Andrew B. Hector, Red Hill, PA (US)

(73) Assignee: HNI Technologies Inc., Muscatine, IA (US)

( * ) Notice: Subject to any disclaimer, the term of this patent is extended or adjusted under 35 U.S.C. 154(b) by 541 days.

(21) Appl. No.: 13/479,054

(22) Filed: May 23, 2012

(65) Prior Publication Data

US 2013/0313883 A1 Nov. 28, 2013

(51) Int. Cl.
*A47C 1/032* (2006.01)

(52) U.S. Cl.
CPC ..... *A47C 1/03294* (2013.01); *A47C 1/03272* (2013.01); *Y10T 29/49826* (2015.01)

(58) Field of Classification Search
CPC ..... A47C 1/03294
USPC ..... 297/317, 318
See application file for complete search history.

(56) References Cited

U.S. PATENT DOCUMENTS

| | | | |
|---|---|---|---|
| 809,944 | A | 1/1906 | Hanger |
| 2,807,310 | A | 9/1957 | Sellner |
| 2,921,622 | A | 1/1960 | Henrickson et al. |
| 3,041,109 | A | 6/1962 | Eames et al. |
| 3,393,941 | A | 7/1968 | Grossfillex |
| D215,837 | S | 11/1969 | Stephens et al. |
| 3,773,383 | A | 11/1973 | Ekornes |
| 3,934,932 | A | 1/1976 | Ekornes |
| 4,045,081 | A | 8/1977 | Ueno |
| 4,084,850 | A | 4/1978 | Ambasz |
| 4,157,203 | A | 6/1979 | Ambasz |
| 4,251,107 | A | 2/1981 | Sato |
| 4,547,017 | A | 10/1985 | Lescure |
| 4,555,139 | A | 11/1985 | Leib |
| 4,709,962 | A | 12/1987 | Steinmann |
| 4,768,829 | A | 9/1988 | Goldman |

(Continued)

FOREIGN PATENT DOCUMENTS

| | | | |
|---|---|---|---|
| AU | 2006347298 | A1 | 2/2008 |
| CA | 2659248 | A1 | 2/2008 |

(Continued)

OTHER PUBLICATIONS

International Search Report and Written Opinion issued in PCT/US2013/042044, Jul. 23, 2013, 12 pages.

*Primary Examiner* — Anthony D Barfield
(74) *Attorney, Agent, or Firm* — Faegre Baker Daniels LLP

(57) ABSTRACT

Some embodiments relate to a chair including a base, a hub, and a seat frame. The hub is supported by the base and includes first and second side mounts and first and second covers. The first side mount is positioned on a first side of the chair and includes a back portion and a bottom portion. The first cover is coupled to the first side mount to define a first channel with the first side mount. The seat frame includes a first lateral member having a lower portion and an upper portion that is pivotally coupled to the back portion of the first side mount and is configured to angulate relative to the lower portion. The lower portion of the first lateral member is slidably received in the first channel such that two sides and a bottom of the lower portion received within the first channel are substantially hidden.

25 Claims, 11 Drawing Sheets

(56) References Cited

U.S. PATENT DOCUMENTS

| | | | | |
|---|---|---|---|---|
| 4,880,273 | A | 11/1989 | Markus | |
| 4,979,778 | A | 12/1990 | Shields | |
| 4,981,326 | A | 1/1991 | Heidmann | |
| 4,984,846 | A | 1/1991 | Ekornes | |
| 5,005,905 | A | 4/1991 | Sondergedl | |
| 5,050,318 | A | 9/1991 | Du Bruyn | |
| 5,080,318 | A | 1/1992 | Takamatsu et al. | |
| 5,102,196 | A | 4/1992 | Kaneda et al. | |
| 5,244,252 | A | 9/1993 | Serber | |
| 5,251,958 | A | 10/1993 | Roericht et al. | |
| 5,303,978 | A | 4/1994 | Murrey | |
| 5,314,237 | A | 5/1994 | Koepke et al. | |
| D351,510 | S | 10/1994 | Lucci et al. | |
| 5,366,274 | A | 11/1994 | Roericht et al. | |
| 5,383,712 | A | 1/1995 | Perry | |
| 5,486,035 | A | 1/1996 | Koepke et al. | |
| 5,522,182 | A | 6/1996 | Rogers | |
| 5,558,399 | A | 9/1996 | Serber | |
| 5,597,203 | A | 1/1997 | Hubbard | |
| 5,611,598 | A | 3/1997 | Knoblock | |
| 5,660,439 | A | 8/1997 | Unwalla | |
| 5,725,277 | A | 3/1998 | Knoblock | |
| 5,735,574 | A | 4/1998 | Serber | |
| 5,785,384 | A | 7/1998 | Sagstuen | |
| 5,806,930 | A | 9/1998 | Knoblock | |
| 5,810,438 | A | 9/1998 | Newhouse | |
| 5,909,923 | A | 6/1999 | DeKraker | |
| 5,957,534 | A | 9/1999 | Wilkerson et al. | |
| 5,979,984 | A | 11/1999 | DeKraker et al. | |
| 6,050,642 | A | 4/2000 | Erb | |
| D423,805 | S | 5/2000 | Olson | |
| 6,056,361 | A | 5/2000 | Cvek | |
| 6,070,937 | A | 6/2000 | Ginat | |
| 6,086,153 | A | 7/2000 | Heidmann et al. | |
| 6,109,694 | A | 8/2000 | Kurtz | |
| 6,109,696 | A | 8/2000 | Newhouse et al. | |
| 6,238,000 | B1 | 5/2001 | Hallmark et al. | |
| 6,257,665 | B1 | 7/2001 | Nagamitsu et al. | |
| 6,435,615 | B1 | 8/2002 | Zapf | |
| D462,846 | S | 9/2002 | Burges | |
| 6,515,931 | B2 | 2/2003 | Marr et al. | |
| 6,533,352 | B1 | 3/2003 | Glass et al. | |
| 6,554,360 | B1 | 4/2003 | Wilke et al. | |
| D476,820 | S | 7/2003 | Nagamitsu | |
| 6,634,717 | B2 | 10/2003 | Kown | |
| 6,641,214 | B2 | 11/2003 | Veneruso | |
| 6,695,404 | B2 | 2/2004 | Bruske | |
| 6,722,735 | B2 | 4/2004 | Lucci et al. | |
| 6,739,663 | B2 | 5/2004 | Gevaert | |
| 6,739,665 | B1 | 5/2004 | Leib et al. | |
| 6,742,840 | B2 * | 6/2004 | Bentley | 297/316 |
| 6,779,846 | B2 | 8/2004 | Spendlove et al. | |
| 6,786,548 | B2 | 9/2004 | Pearce et al. | |
| 6,863,346 | B2 | 3/2005 | Zund | |
| 6,923,503 | B2 | 8/2005 | Sangiorgio | |
| 6,935,690 | B2 | 8/2005 | Lucci et al. | |
| D509,969 | S | 9/2005 | Loew et al. | |
| 6,945,602 | B2 | 9/2005 | Fookes et al. | |
| D513,457 | S | 1/2006 | Asano et al. | |
| 6,986,549 | B2 | 1/2006 | Kniese | |
| 7,004,543 | B2 | 2/2006 | Caruso et al. | |
| D518,304 | S | 4/2006 | Crescenti | |
| 7,073,860 | B2 | 7/2006 | Markus | |
| 7,073,864 | B2 | 7/2006 | Olsen | |
| 7,114,777 | B2 | 10/2006 | Knoblock et al. | |
| 7,114,782 | B2 | 10/2006 | Ambasz | |
| 7,118,177 | B2 | 10/2006 | Piretti | |
| D535,126 | S | 1/2007 | Loew et al. | |
| 7,159,937 | B2 | 1/2007 | Williamson et al. | |
| D536,890 | S | 2/2007 | Loew et al. | |
| D543,385 | S | 5/2007 | Loew et al. | |
| 7,234,774 | B2 | 6/2007 | Heidmann et al. | |
| 7,267,405 | B2 | 9/2007 | Tin | |
| D552,368 | S | 10/2007 | Scheper et al. | |
| D557,917 | S | 12/2007 | Nakamura et al. | |
| 7,334,842 | B1 | 2/2008 | Wu et al. | |
| 7,360,835 | B2 | 4/2008 | Tubergen et al. | |
| 7,472,962 | B2 | 1/2009 | Caruso et al. | |
| 7,484,803 | B2 | 2/2009 | Dozsa-Farkas | |
| D599,126 | S | 9/2009 | Chen et al. | |
| 7,611,202 | B2 | 11/2009 | Johnson et al. | |
| 7,621,600 | B2 | 11/2009 | Buchbinder | |
| D612,175 | S | 3/2010 | Kubryk | |
| 7,686,395 | B2 | 3/2010 | Piretti | |
| 7,695,067 | B2 | 4/2010 | Goetz et al. | |
| D623,879 | S | 9/2010 | Kubryk | |
| D628,831 | S | 12/2010 | Schmitz et al. | |
| D637,839 | S | 5/2011 | Piretti | |
| 7,997,652 | B2 | 8/2011 | Roslund et al. | |
| D646,092 | S | 10/2011 | Romero | |
| D648,143 | S | 11/2011 | Lambert et al. | |
| D648,147 | S | 11/2011 | Izawa | |
| D648,968 | S | 11/2011 | Piretti et al. | |
| 8,061,775 | B2 | 11/2011 | Diffrient | |
| D650,616 | S | 12/2011 | Piretti | |
| D653,871 | S | 2/2012 | Jakobsen et al. | |
| D654,280 | S | 2/2012 | Fujita | |
| D654,286 | S | 2/2012 | Burges | |
| D656,329 | S | 3/2012 | Nakamura et al. | |
| D660,056 | S | 5/2012 | Diffrient | |
| D661,135 | S | 6/2012 | Diffrient | |
| D663,976 | S | 7/2012 | Kubryk | |
| D666,841 | S | 9/2012 | Czumaj-Bront et al. | |
| D669,278 | S | 10/2012 | Kumazawa | |
| D671,330 | S | 11/2012 | Izawa | |
| D673,395 | S | 1/2013 | Piretti | |
| D673,396 | S | 1/2013 | Piretti | |
| D675,463 | S | 2/2013 | Collinson et al. | |
| 8,414,073 | B2 | 4/2013 | Schmitz et al. | |
| D685,598 | S | 7/2013 | Hori et al. | |
| D687,642 | S | 8/2013 | Hsuan-Chin | |
| D688,482 | S | 8/2013 | Choi | |
| 2001/0030457 | A1 | 10/2001 | Gregory | |
| 2002/0117883 | A1 | 8/2002 | Gevaert | |
| 2003/0080595 | A1 | 5/2003 | Wilkerson et al. | |
| 2004/0245840 | A1 | 12/2004 | Tubergen et al. | |
| 2005/0001461 | A1 | 1/2005 | Caruso et al. | |
| 2005/0001464 | A1 | 1/2005 | Caruso et al. | |
| 2005/0161990 | A1 | 7/2005 | Piretti | |
| 2005/0258678 | A1 | 11/2005 | Wilkerson et al. | |
| 2006/0022506 | A1 | 2/2006 | Chan | |
| 2006/0103222 | A1 | 5/2006 | Caruso et al. | |
| 2006/0202530 | A1 | 9/2006 | Lin | |
| 2006/0244294 | A1 | 11/2006 | Dozsa-Farkas | |
| 2007/0001497 | A1 | 1/2007 | Diffrient | |
| 2007/0063563 | A1 | 3/2007 | Maze et al. | |
| 2008/0272636 | A1 | 11/2008 | Machael et al. | |
| 2009/0102268 | A1 | 4/2009 | Schmitz et al. | |
| 2009/0152930 | A1 | 6/2009 | Diffrient | |
| 2009/0195040 | A1 | 8/2009 | Birkbeck | |

FOREIGN PATENT DOCUMENTS

| | | | | |
|---|---|---|---|---|
| CH | 353144 | A * | 3/1961 | A47C 1/03294 |
| DE | 810177 | C | 5/1951 | |
| DE | 2359440 | A1 | 6/1974 | |
| DE | 3045367 | A1 * | 6/1982 | A47C 1/03294 |
| DE | 3313677 | C2 | 10/1984 | |
| DE | 3907206 | A1 | 9/1990 | |
| DE | 29601935 | U1 | 3/1996 | |
| EP | 0096273 | A2 | 12/1983 | |
| EP | 0559185 | A1 | 9/1993 | |
| EP | 1327400 | A2 | 7/2003 | |
| GB | 2041735 | A | 9/1980 | |
| GB | 2429405 | A | 2/2007 | |
| WO | WO2008020824 | A2 | 2/2008 | |

* cited by examiner

CHAIR WITH PIVOT FUNCTION AND METHOD OF MAKING

BACKGROUND

Many chairs, particularly office chairs, have weight activated backward tilt. By this it is meant that a user shifting his or her weight is able to tilt the back portion of the chair to a reclining position. When the user shifts his/her weight back to an upright posture, or when the user departs, the chair returns to its neutral position on its own. This phenomenon is often described as being "passive." When the user shifts his/her weight forward, a spring returns the back portion of the chair to its upright position. Some office chairs are arranged so that the seat portion also moves in response to tilting of the back portion and is commonly referred to as being synchronous. Sometimes the seat portion is fixed to the back portion so that they pivot about the same angle and in other chairs the seat portion is arranged to be lowered or raised at a different rate than the rate of decline of the back portion resulting in different angular movements of the back portion and the seat portion.

SUMMARY

Some embodiments relate to a chair including a base, a hub, and a seat frame. The base is configured to support the chair on a surface. The hub is supported by the base and includes first and second side mounts and first and second covers. The first side mount is positioned on a first side of the chair and includes a back portion and a bottom portion. The second side mount is positioned on the second side of the chair and includes a back portion and a bottom portion. The first cover is coupled to the first side mount to define a first channel with the first side mount. The second cover is coupled to the second side mount to define a second channel with the second side mount. The seat frame includes a first lateral member having a lower portion and an upper portion that is pivotally coupled to the back portion of the first side mount and is configured to angulate relative to the lower portion. The lower portion of the first lateral member is slidably received in the first channel such that two sides and a bottom of the lower portion received within the first channel are substantially hidden from view. The seat frame also includes a second lateral member having a lower portion and an upper portion that is pivotally coupled to the back portion of the second side mount and is configured to angulate relative to the lower portion. The lower portion of the second lateral member is slidably received in the second channel such that two sides and a bottom of the lower portion received within the second channel are substantially hidden from view.

Other embodiments relate to a chair including a first side mount positioned on a first side of the chair and having a back portion that extends substantially vertically and a bottom portion that extends substantially horizontally and defines a first channel. The chair also includes a second side mount positioned on a second side of the chair and having a back portion that extends substantially vertically and a bottom portion that extends substantially horizontally and defines a second channel. A seat frame of the chair includes a first lateral member including a lower portion and an upper portion coupled to the lower portion such that lower portion and the upper portion are configured for angulation relative to one another. The lower portion of the first lateral member is slidably received in the first channel. The first channel defines a slide surface and the lower portion of the first lateral member has a bushing slidably received against the slide surface such that the lower portion of the first lateral member is raised vertically as the upper portion of the first lateral member is pivoted backward relative to the first side mount. The seat frame also includes a second lateral member including a lower portion and an upper portion coupled to the lower portion such that lower portion and the upper portion are configured for angulation relative to one another. The lower portion of the second lateral member is slidably received in the second channel.

Other embodiments relate to a chair including a seat frame including a first lateral member including a lower portion and an upper portion coupled to the lower portion such that lower portion and the upper portion are configured for angulation relative to one another, the lower portion of the first lateral member being slidably received in a first channel of a first side mount of the chair. The chair also includes a second lateral member including a lower portion and an upper portion coupled to the lower portion such that lower portion and the upper portion are configured for angulation relative to one another. The lower portion of the second lateral member is slidably received in a second channel of a second side mount of the chair. The chair also includes means for raising the lower portions of the first and second lateral members vertically as the upper portion of the first lateral member is pivoted backward with the back portion of the first side mount, as well as means for supporting a user's weight between the first and second lateral members.

Still other embodiments relate to a method of making a chair including tensioning a seating material between a first lateral member having an upper portion and a lower portion and a second lateral member having an upper portion and a lower portion. A back cross member is secured between the upper portions of the first and second lateral members and a front cross member is secured between the lower portions of the first and second lateral members. The first and second lateral members are released onto first and second side mounts of a chair hub such that the first and second side mounts resist compression between the first and second lateral members.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 13 shows the chair in an unreclined state and FIG. 14 shows the chair in a reclined state, according to some embodiments.

The figures are meant to be illustrative in nature and are not to be taken as exclusive or limiting in scope.

DETAILED DESCRIPTION

Figure 1:
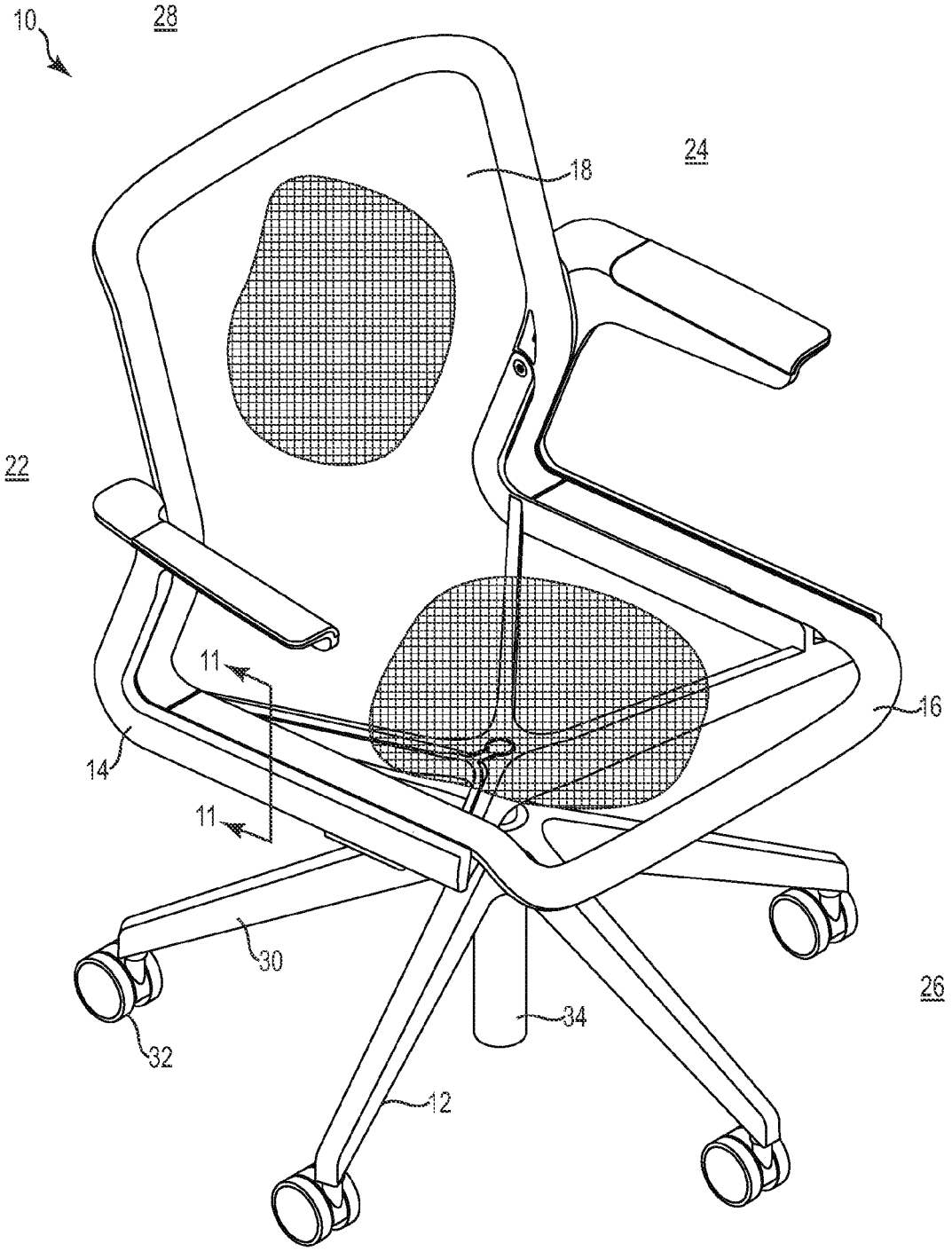
FIG. 1 is a perspective view of a chair, according to some embodiments.

FIG. 1 is a perspective view of a chair 10, according to some embodiments. As shown, the chair 10 includes a base 12, a hub 14, a seat frame 16, and a seat member 18. Generally, the base 12 supports the hub 14 on a surface, the hub 14 maintains the seat frame 16, and the seat frame 16, in turn, maintains the seat member 18. As indicated in FIG. 1, the chair 10 defines a first side 22, a second side 24, a front 26, and a back 28. As subsequently described, the chair 10 provides compact and hidden tilt and lift features, along with effective tensioned assembly features that facilitate ease of assembly of the chair 10, although a variety of additional or alternative features and advantages are contemplated according to various embodiments.

Figure 15:
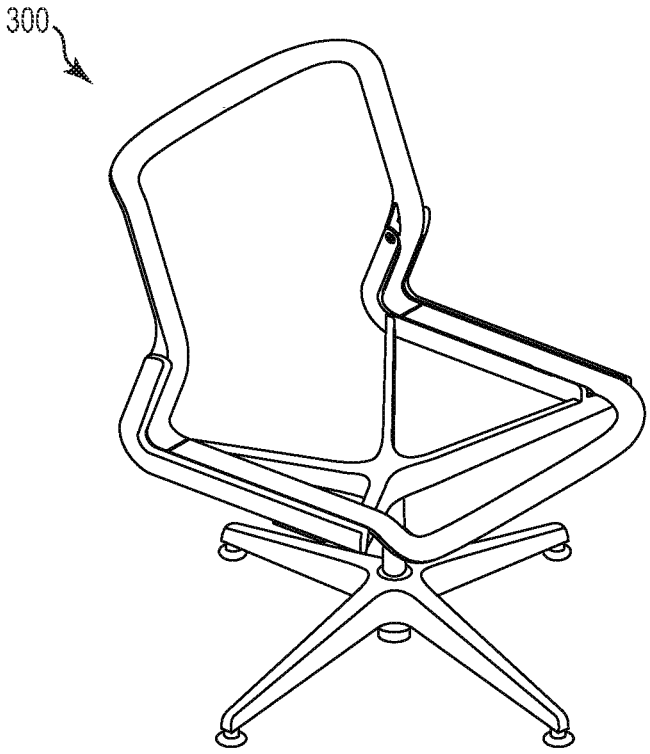
FIG. 15 shows another chair, according to some embodiments.

In some embodiments, the base 12 includes a pedestal with casters (e.g., as shown in FIG. 1) or without casters (e.g., as shown in FIG. 15). The base 12 is formed of cast metal or other material as desired. In other embodiments, the base 12 can be any of a variety of fixed or mobile structures, including a base that is part of a stadium seating support, such as those found in movie theaters, an airplane seating support, an automobile seating support, or any of a variety of other seating supports. As shown in FIG. 1, the base 12 includes a plurality of legs 30, a plurality of casters 32 attached to the legs 30, and a pneumatic height adjustment cylinder 34.

Figure 2:
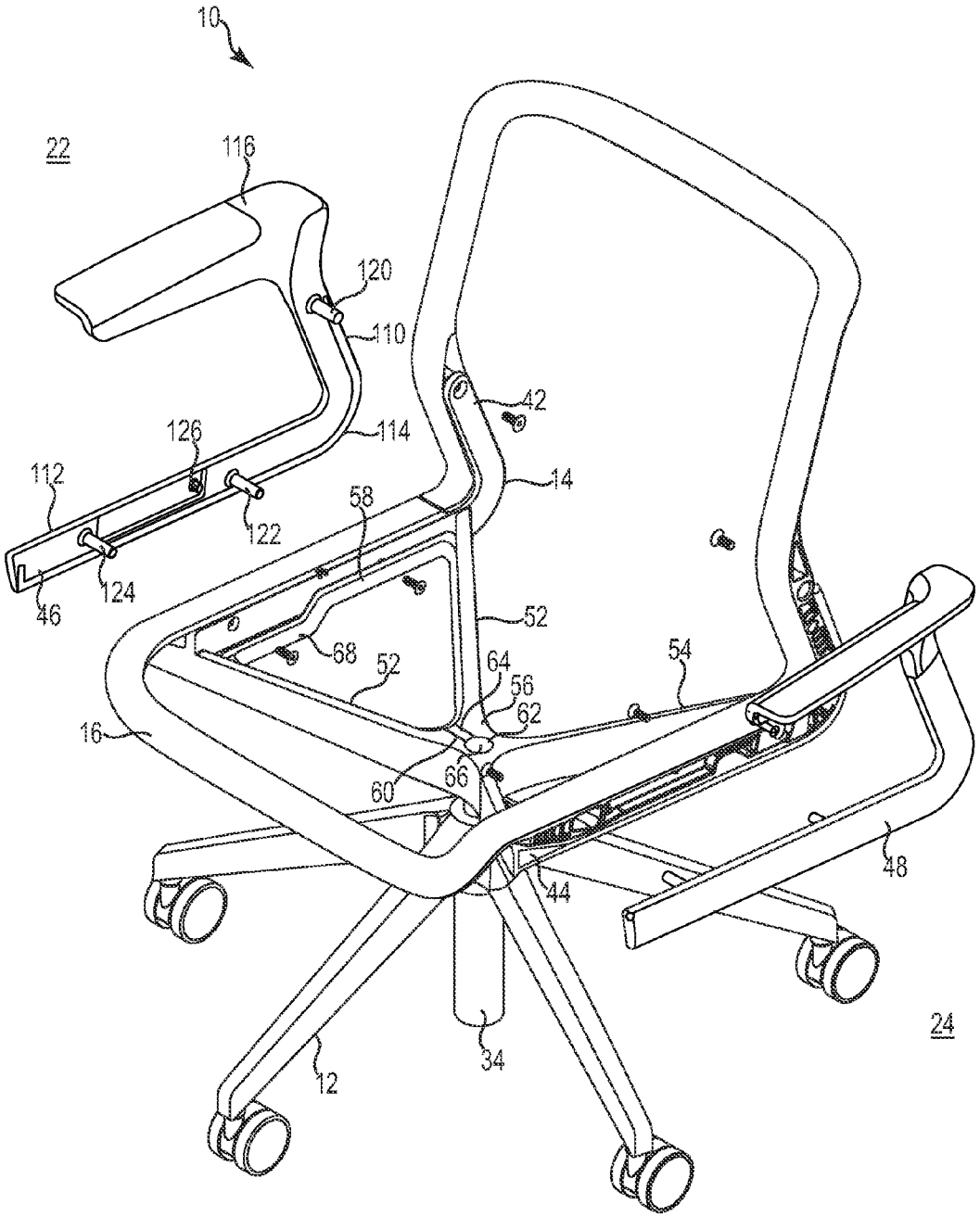
FIG. 2 is a perspective view of the chair of FIG. 1 in a partially disassembled state, according to some embodiments.

FIG. 2 is a perspective view of the chair 10 in a partially disassembled state, according to some embodiments. As shown, the hub 14 includes a first side mount 42 positioned on the first side 22 of the chair 10, a second side mount 44 positioned on the second side 24 of the chair 10, a first cover 46 configured to form a complementary fit with the first side mount 42, and a second cover 48 configured to form a complementary fit with the second side mount 44. The hub 14 is formed of cast metal or other material as desired.

As shown in FIG. 2, the hub 14 also includes a first pair of struts 52 and a second pair of struts 54 meeting at a central portion 56, the first and second pairs of struts 52, 54 and the central portion 56 defining a substantially X-shape overall. As shown, the struts 52, 54 and central portion 56 couple the first and second side mounts 42, 44 together.

In some embodiments, the central portion 56 includes a channel 60 and through hole 62 for receiving the pneumatic height adjustment cylinder 34. The hub 14 also includes a height adjustment handle 58 that is substantially triangular in shape overall and includes a fulcrum piece 64, a cylindrical actuator 66, and a finger extension 68. The handle 58 is substantially triangular in shape overall and forms a complementary fit with, and is received within a perimeter defined by the first pair of struts 52, the central portion 56, and the first side mount 42. The finger extension 68 is configured to be manipulated by a user (e.g., pulled upward or depressed) to move the cylindrical actuator 66 in order to actuate the pneumatic height adjustment cylinder 34. Due to the complementary fit between the handle 58 and the surrounding portions of the hub 14, the handle 58 is largely camouflaged from view, according to some embodiments.

Figure 3:
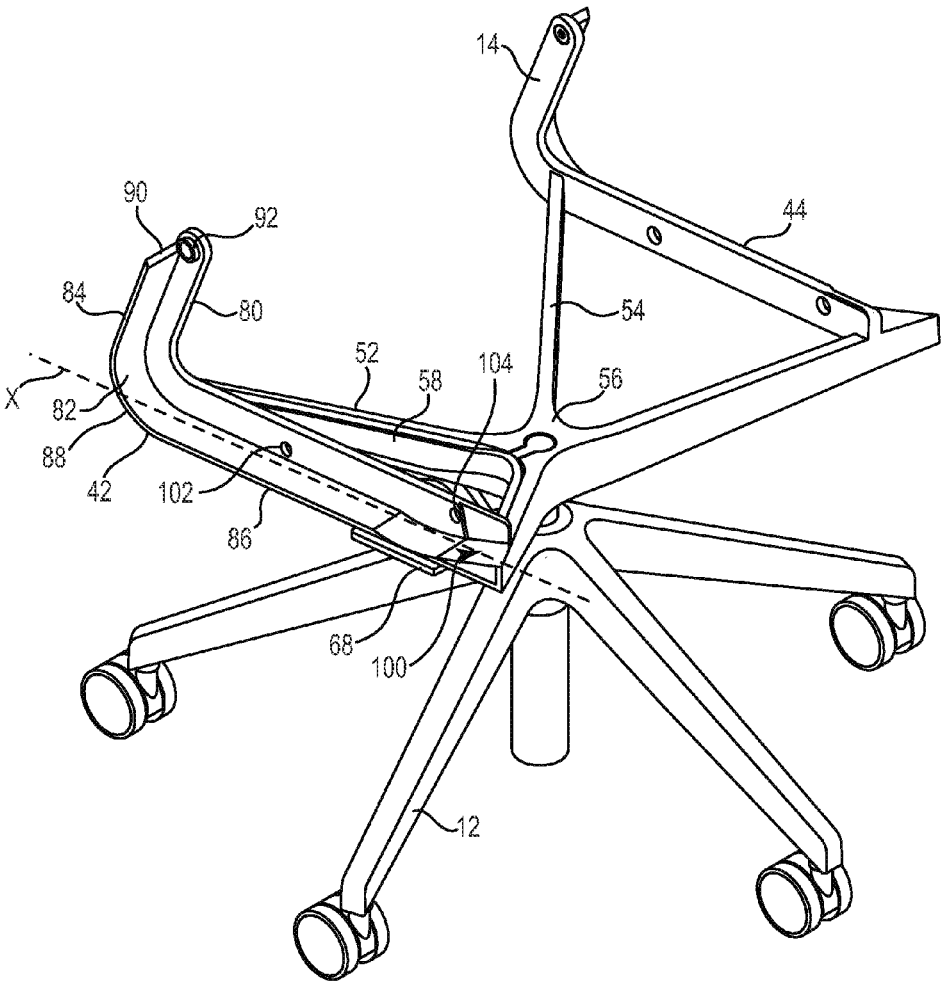
FIG. 3 is a perspective view of a base and hub of the chair of FIG. 1 with opposing covers removed from the hub, according to some embodiments.

FIG. 3 is a perspective view of the base 12 and the hub 14 together with the covers 46, 48 removed from the hub 14, according to some embodiments. In some embodiments, the first and second side mounts 42, 44 are substantially similar. Therefore, as features are described in association with the first side mount 42 such description should be taken to be applicable to corresponding features of the second side mount 44. In some embodiments, the first side mount 42 includes an inner wall 80, a bottom wall 82 and defines a back portion 84, a bottom portion 86, and a connecting portion 88.

As shown in FIG. 3, the first side mount 42 is substantially L-shaped overall. The back portion 84 extends substantially vertically and at an angle relative to the bottom portion 86 (e.g., from about 20 degrees to about 160 degrees). In some embodiments, the back portion 84 extends at an acute angle relative to the bottom portion 86 (e.g., about 63 degrees). The bottom portion 86 optionally extends substantially horizontally. In some embodiments, the bottom portion 86 is offset from being exactly horizontal (also described as "true horizontal" herein) relative to a horizontal surface (e.g., a floor) on which the chair 10 rests. For example, the bottom portion 86 is optionally offset from true horizontal from about 0 degrees to about 45 degrees. As shown, the bottom portion 86 is offset from true horizontal by about 6 to about 12 degrees, for example. The connecting portion 88 is substantially curved and extends between the back and the bottom portions 84, 86.

As shown in FIG. 3, the back portion 84 of the first side mount 42 defines a terminal end 90 with a pivot aperture 92 formed through the inner wall 80 and located toward the terminal end 90. In some embodiments, the bottom portion 86 forms an angled sliding surface 100. In some embodiments, the angled sliding surface 100 is angled upwardly relative to a longitudinal axis X of the first side mount 42 by about 15 degrees, although a variety of angles are contemplated (e.g., from about 0 to about 30 degrees). The bottom portion 86 also includes a first fastener aperture 102 and a second fastener aperture 104. In some embodiments, the sliding surface 100 is substantially straight. In other embodiments, the sliding surface 100 is substantially curved or includes segments that are straight and segments that are curved (not shown).

In some embodiments, the first and second covers 46, 48 are substantially similar. Therefore, as features are described in association with the first cover 46 such description should be taken to be applicable to corresponding features of the second cover 48. As shown in FIG. 2, the first cover 46 includes a back portion 110, a bottom portion 112, a connecting portion 114 extending between the back portion 110 and the bottom portion 112, and an armrest portion 116 extending from the back portion 110.

In some embodiments, the first cover 46 has a substantially complementary shape to the first side mount 42. As shown in FIG. 2, the back portion 110 has a substantially similar profile to the inner wall 80 of the first side mount 42 at the back portion 84 (FIG. 3). The bottom portion 112 has a substantially similar profile to the inner wall 80 at the bottom portion 86 (FIG. 3). The connecting portion 114 has a substantially similar profile to the inner wall 80 at the connecting portion 88 (FIG. 3).

As shown in FIG. 2, the back portion 110 includes a fastener post 120 configured to be received by the pivot aperture 92. The bottom portion 112 includes first and second fastener posts 122, 124 to be received by the first and second fastener apertures 102, 104. As shown, the bottom portion 112 also includes a spring boss 126 for receiving a tension or compression spring.

Figure 4:
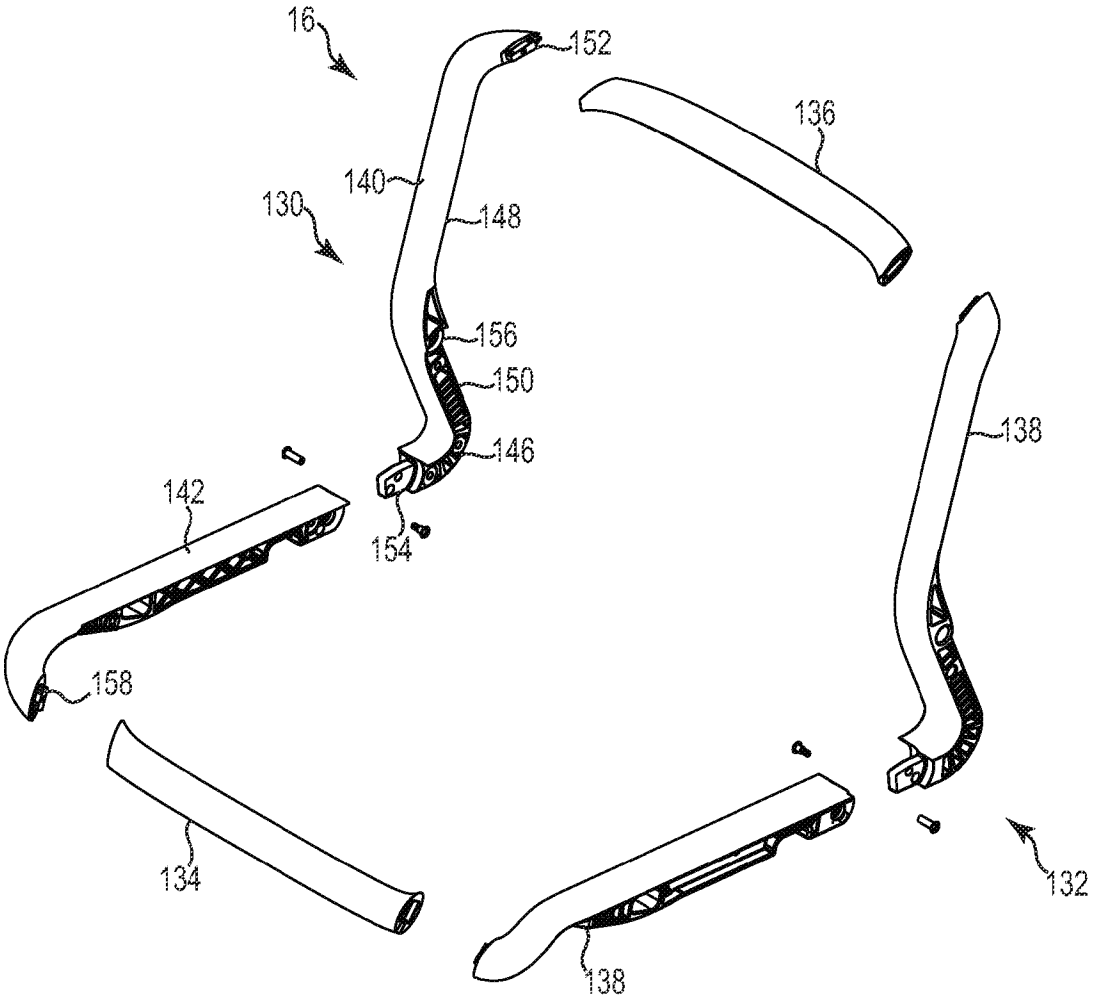
FIG. 4 is a perspective view of a seat frame of the chair of FIG. 1 in a disassembled state, according to some embodiments.

FIG. 4 shows the seat frame 16 in a disassembled state from a perspective view, according to some embodiments. The seat frame is optionally formed of a polymeric material, such as Polypropylene, for example, although a variety of materials are contemplated. As shown, the seat frame 16 includes a first lateral member 130, a second lateral member 132, a front cross member 134, and a back cross member 136. As shown, the seat frame 16 includes a keder channel 138, also described as a keder groove, that is formed into an outwardly facing side and extends around the seat frame 16 in each of the first and second lateral members 130, 132 and the front and back cross members 134, 136. In some embodiments, the first and second lateral members 130, 132 are substantially similar. Therefore, as features are described in association with the first lateral member 130 such description should be taken to be applicable to corresponding features of the second lateral member 132.

Figure 11:
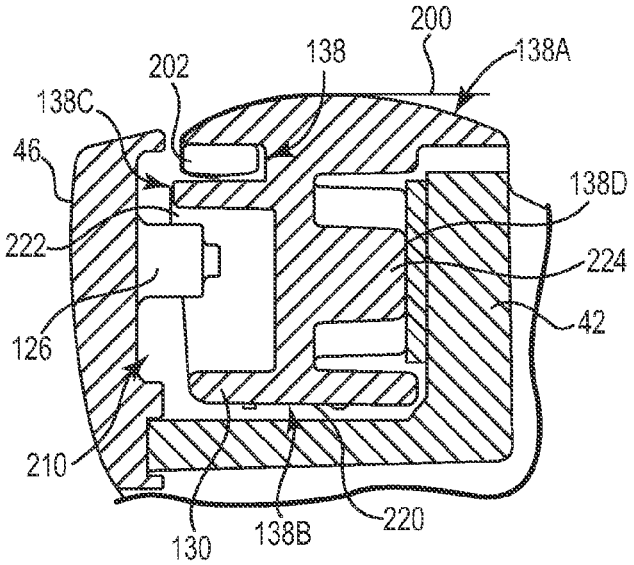
FIG. 11 is a cross section through the chair at line 11-11 in FIG. 1, according to some embodiments.

As shown in FIG. 11, the first lateral member 130 has a top 138A, a bottom 138B, a first side 138C, and a second side 138D, and includes an upper portion 140 and a lower portion 142. As shown in FIG. 4, the upper portion 140 includes a corner section 146 that is substantially rigid or is otherwise generally inflexible under typical operating conditions, a back rest section 148, and a lower back section 150. As shown, portions of the first lateral member 130 are substantially complementary in shape to the first side mount 42 and the first cover 46. The corner section 146 has a similar side profile to the inner wall 80 of the first side mount 42 at the connecting portion 88 (FIG. 3). The lower back section 150 has a similar side profile to the inner wall 80 at the back portion 84 (FIG. 3).

In some embodiments, the upper portion 140 of the first lateral member 130 includes a mating feature 152 to align the first lateral member with the back cross member 136. As shown, the corner section 146 includes a tongue 154 for pivotally mating with the lower portion 142 and the back rest section 148 includes a pivot aperture 156 through which the fastener post 120 of the first cover 46 is received.

Figure 5:
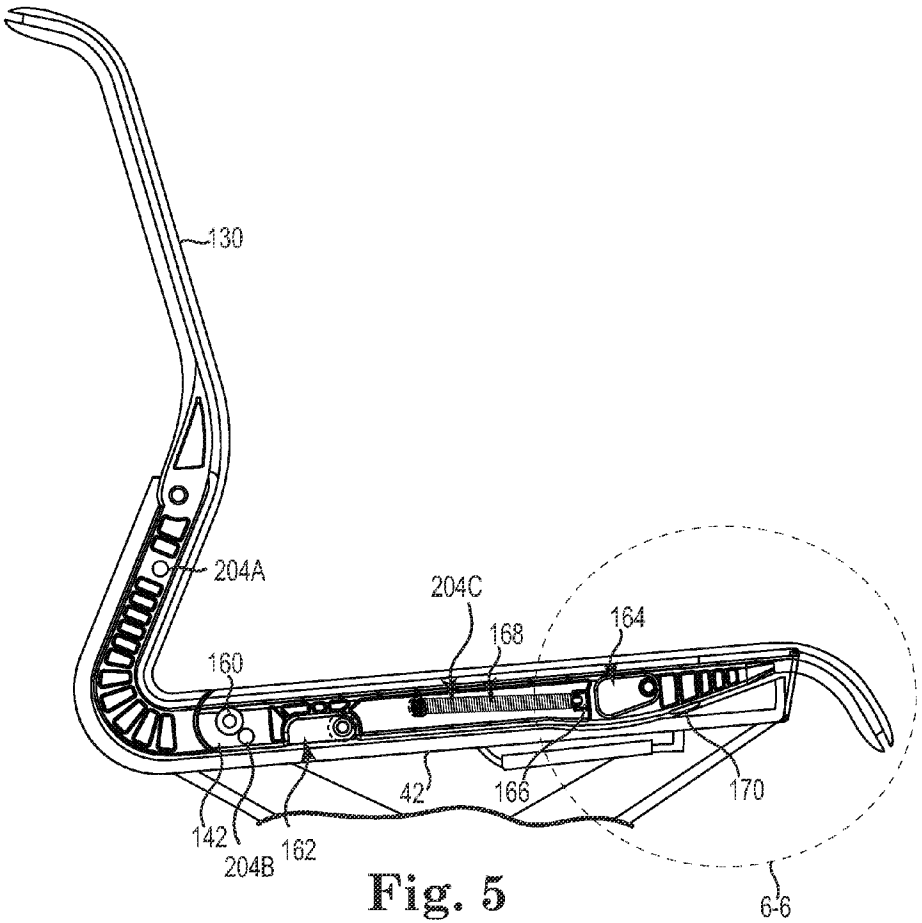
FIG. 5 shows a portion of the chair of FIG. 1 from a side view with a first cover removed, according to some embodiments.

As shown in FIG. 4, the lower portion 142 of the first lateral member 130 includes a mating feature 158 to align the first lateral member with the front cross member 134. FIG. 5 shows a portion of the chair 10 from a side view with the first cover 46 removed, according to some embodiments. As shown, the lower portion 142 of the first lateral member 130 has a complementary side profile to the bottom portion 86 of the first side mount 42, the lower portion 142 including a pivot aperture 160 and groove (not shown) for pivotally mating with the tongue 154, a first slot 162 for receiving the first fastener post 122, a second slot 164 for receiving the second fastener post 124 such that the first lateral member 130 has sufficient room to slide forward and upward without engaging the second fastener post 124, and a spring retainer 166 for receiving a first end of a spring 168 (e.g., a tension or compression spring). According to some embodiments, the second slot 164 also helps to prevent the first lateral member 130 from being inadvertently lifted out of the channel 138 (e.g., by a user picking up the chair by the seat member 18) and also serves to provide forward and backward limits to sliding as desired.

Figure 6:
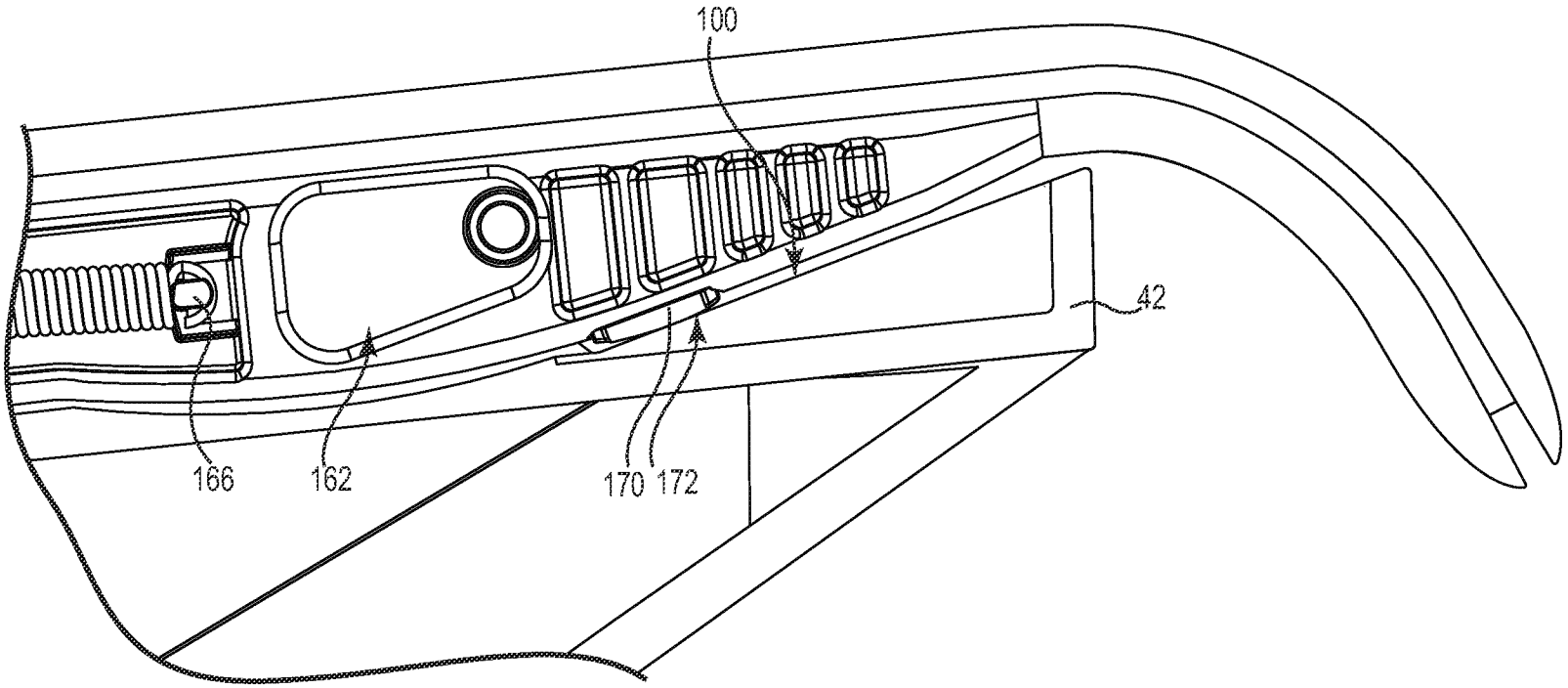
FIG. 6 is an enlarged view of area 6-6 designated on FIG. 5, according to some embodiments.

FIG. 6 is an enlarged view of area 6-6 designated on FIG. 5, according to some embodiments. As shown, the lower portion 142 of the first lateral member 130 also includes a slide bushing 170 having a rounded contact surface 172 for slidably engaging the sliding surface 100 of the first side mount 42.

As shown in FIG. 4, the front and back cross members 134, 136 are configured to extend between the first and second lateral members 130, 132 such that the front and back cross members 134, 136 resist compressive forces between the first and second lateral members 130, 132.

Figure 7:
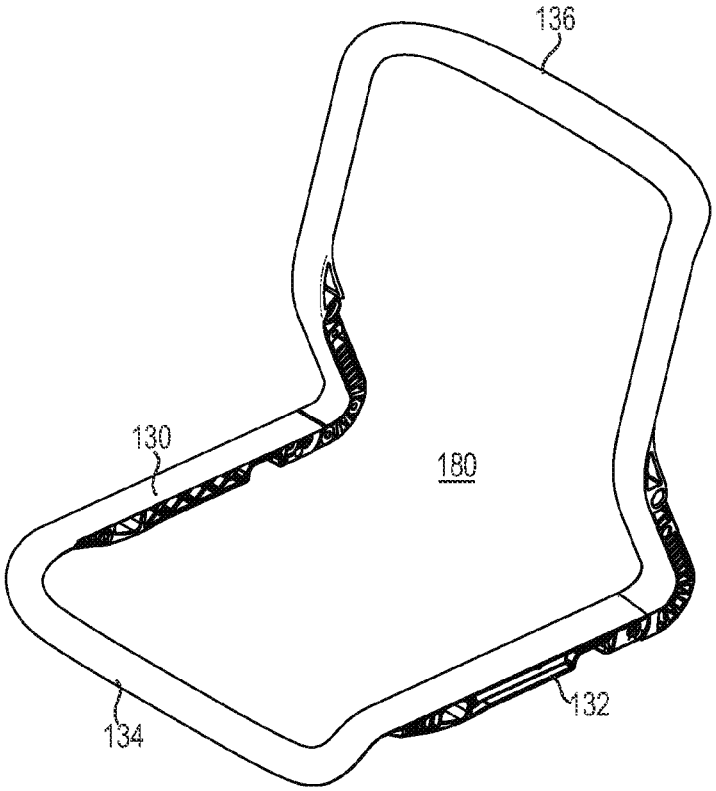
FIG. 7 is an assembled view of the seat frame 16, according to some embodiments.
Figure 13:
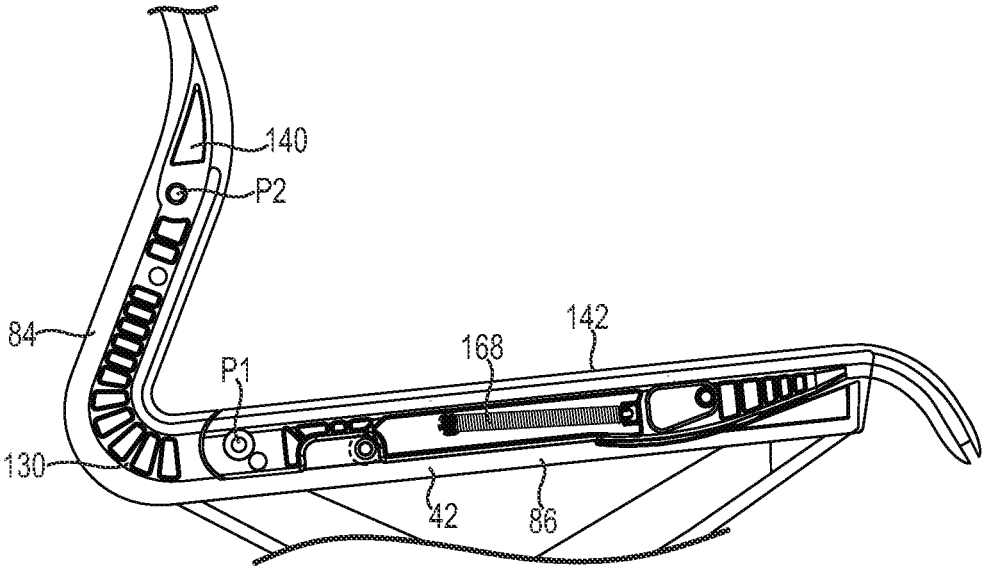
FIGS. 13 and 14 are illustrative of a tilt and lift function of the chair of FIG. 1, according to some embodiments, where

FIG. 7 is an assembled view of the seat frame 16, according to some embodiments. As understood with reference between FIGS. 4 and 7, assembly of the seat frame 16 includes assembling the upper portion 140 to the lower portion 142 of the first lateral member 130 by inserting the tongue 154 into the groove (not shown) and securing a pin or other fastener through the pivot aperture 160 (FIG. 5) in the lower portion 142 and through the tongue 154 such that the lower portion 142 is free to angulate relative to the upper portion 140 by pivoting with the upper portion 140 at a pivot point P1 (FIG. 13). While the upper portion 140 and lower portion 142 are optionally pivotally coupled, in other embodiments, the upper and lower portions 140, 142 are flexibly coupled (e.g., the corner section 146 and/or section corresponding to pivot aperture 160 is optionally flexible) in order to facilitate angulation between the upper portion 140 and the lower portion 142. The second lateral member 132 is optionally similarly assembled.

Figure 8:
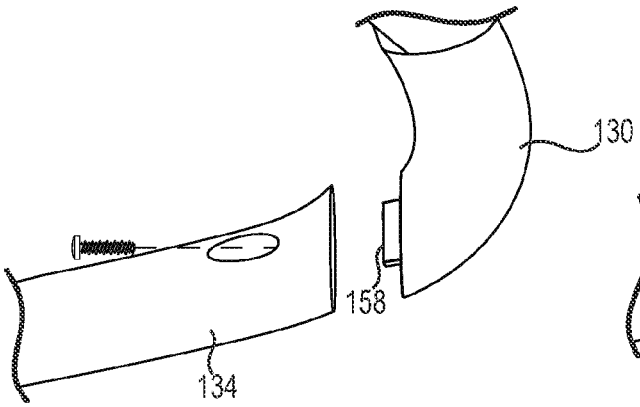
FIG. 8 shows a mating feature of a first lateral member of a seat frame of the chair of FIG. 1 before mating with a front cross member of seat frame, according to some embodiments.
Figure 9:
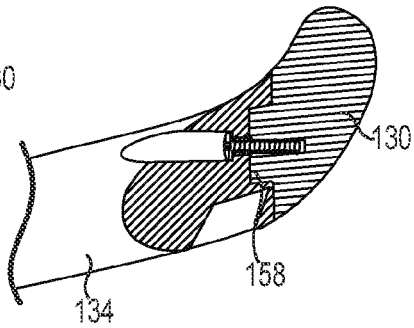
FIG. 9 is a partial cross section showing the mating feature of FIG. 8 mated with the front cross member following assembly of the front cross member and the first lateral member, according to some embodiments.

In some embodiments, the front and back cross members 134, 136 are sandwiched between the first and second lateral members. FIG. 8 shows the mating feature 158 of the first lateral member 130 before mating with the front cross member 134 and FIG. 9 is a partial cross section showing the mating feature 158 of the first lateral member 130 mated with the front cross member 134 following assembly of the front cross member and the first lateral member 130, according to some embodiments. As shown in FIG. 7, following assembly, the seat frame 16 defines an open center 180.

Figure 10:
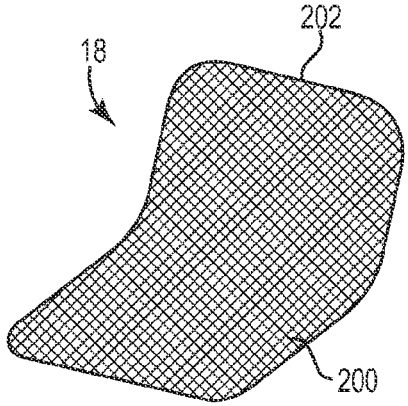
FIG. 10 shows a seat member of the chair of FIG. 1, according to some embodiments.

FIG. 10 shows the seat member 18, according to some embodiments. As shown, the seat member 18 includes seating material 200, such as an elastic material, and a keder 202, also described as a border tab, sewn or otherwise attached to the perimeter of the seating material 200. In some embodiments, the seating material is an elastic mesh material, such as polyester and polyester copolymer available from Matrex of North Carolina. FIG. 11 is a cross section through the chair at line 11-11 in FIG. 1, according to some embodiments. As shown, the keder 202 of the seat member 18 is configured to be received in the keder channel 138 of the seat frame 16 such that seat member 18 is secured to the seat frame 16 under tension to provide means for supporting the weight of a user.

Having introduced various features of the chair 10, according to some embodiments, some methods of assembling the chair 10 include assembling the base 12 and the hub 14 as desired, with the covers 46, 48 removed. The keder 202 is secured in the keder channels 138 in each of the lateral members 130, 132 and then the mesh is tensioned between the lateral members 130, 132 material by pulling the lateral members 130, 132 apart (e.g., using a tensioning fixture set at a tension of about 1000 lbs). In some embodiments, pulling members (not shown), such as hooks, pins, bolts, or other types of fasteners, are secured to the lateral members 130, 132 by securing the pulling members in assembly apertures 204A, 204B, 204C (FIG. 5) in the first lateral member 130 and similar apertures in the second lateral member 132. In FIG. 5, a position of 204C is indicated generally, though the aperture 204C is hidden behind spring 168, according to some embodiments. The pulling members are, in turn, secured to a tensioning system (e.g., a pneumatic or hydraulic system) and the lateral members 130, 132 are tensioned apart. Once the lateral members 130, 132 are spaced apart as desired, the front and back cross members 134, 136 are positioned in an appropriate location between the lateral members 130, 132, as are the first and second side mounts 42, 44.

In some embodiments, at least some of the tension in the mesh material is released, the keder 202 is secured in the keder channel 138 in each of the front and back cross members 134, 136, and the cross members 134, 136 are secured between the lateral members 130, 132. The lateral members 130, 132 are also released onto the side mounts 42, 44, such that the first and second side mounts 42, 44 and the cross members 134, 136 resist compressive force exerted by the seating material 200 between the first and second lateral members 130, 132. The lateral members are released onto the side mounts with the pivot apertures 92 of the side mounts aligned to the pivot apertures 156 of the lateral members, the first slots 162 of the side mounts aligned with the first fastener apertures 102 of the lateral members, the second fastener apertures 104 of the side mounts aligned with the second slots 164 of the lateral members, and the bushings 170 of the lateral members slidably received on the sliding surfaces 100 of the side mounts.

Figure 12:
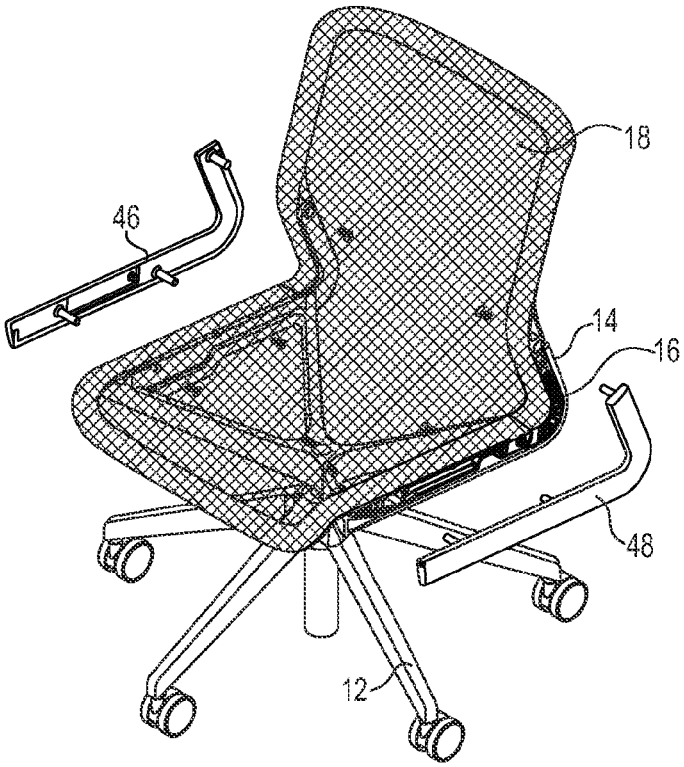
FIG. 12 is a perspective view of the seat frame of the chair of FIG. 1 secured onto the hub of the chair prior to attaching the covers, according to some embodiments.

FIG. 12 is a perspective view of the seat frame 16 secured onto the hub 14 prior to attaching the covers 46, 48, according to some embodiments. In some embodiments, the covers 46, 48 are attached to the side mounts 42, 44, respectively, such that various features of the lateral members 130, 132 are substantially hidden from view. As shown in FIG. 11, the first cover 46 and the first side mount 42 combine to define a U-shaped channel 210 in which the first lateral member 130 is slidably received and substantially hidden from view. In particular, and as shown in FIG. 11, where the first lateral member is received in the channel 210, the bottom 220 and sides 222, 224 of the first lateral member 130, including the keder channel 138 are substantially hidden from view.

The first cover 46 is secured to the first side mount 42 by inserting the fastener post 120 through the pivot apertures 92 into alignment with the pivot aperture 156 and securing a fastener (e.g., a bolt) therethrough, by inserting the fastener post 122 through the slot 162 into alignment with the fastener aperture 102 and securing a fastener (e.g., a bolt) therethrough, and by inserting the fastener post 124 through the slot 164 into alignment with the fastener aperture 104 and securing a fastener (e.g., a bolt) therethrough. Following assembly, the upper portion 140 of the lateral member 130 is pivotally coupled to the back portion 84 of the side mount 42 at a pivot point P2 (FIG. 13) and the lower portion 142 is slidably received in the channel 210 such that a user (not shown) tilting back on the chair causes the upper portion 140 to pivot backward and the lower portion 142 to slide forward and upward with the bushing 170 riding on the sliding surface 100. The second cover 48 is similarly secured to the second side mount 44, according to some embodiments.

Figure 14:
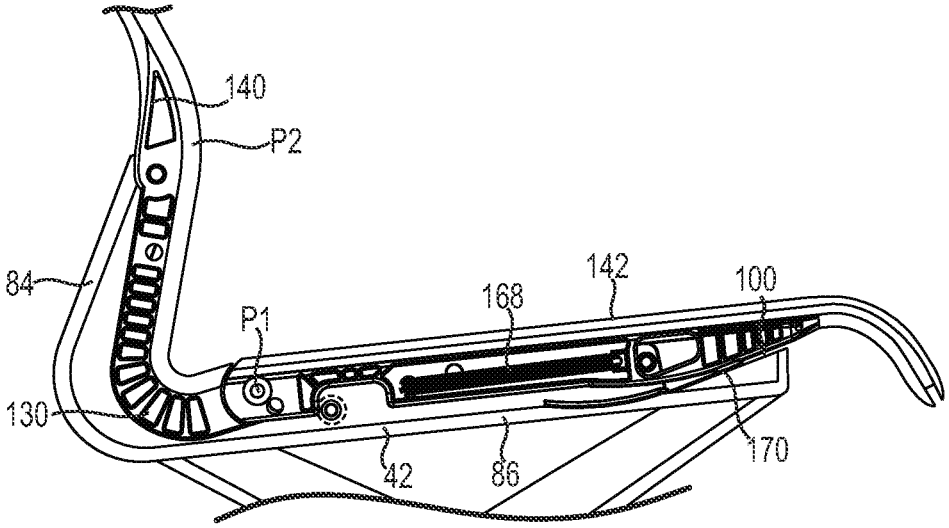

FIGS. 13 and 14 are illustrative of the tilt and lift function of the chair 10, according to some embodiments, where FIG. 13 is the chair 10 in an unreclined state and FIG. 14 is the chair in a reclined state, according to some embodiments. FIGS. 13 and 14 show the chair 10 from a side view with the first cover 46 removed for ease of understanding. As shown, as the user tilts back the upper portion 140 of the lateral member 130 pivots about pivot point P2 with respect to the back portion 84 of the first side mount 42. The upper and lower portions 140, 142 angulate with respect to one another and the lower portion 142 slides forward and is lifted as the bushing 170 rides upward on the sliding surface 100 providing means for raising the lower portions of the lateral members vertically as the upper portions of the lateral members are pivoted backward. While some embodiments include the bushing 170 residing on the lower portion 142, in other embodiments the sliding surface 100 is formed into the lower portion 142 and the bushing resides on the first side mount 42.

According to some embodiments, with the seat member 18 assembled in the side of the seat frame 16 the chair 10 provides a more uniform aesthetic when viewed from various positions. As shown, the type of assembly avoids a more traditional window frame appearance for the seat and provides a full perimeter frame with a substantially continuous seating material 200 between back and seat portions of the seating material 200.

The spring 168, which is secured between the first cover 46 (at the spring boss 126—not shown in FIGS. 13 and 14 with the cover 46 removed) and the lower portion 142 (at the spring retainer 166) is a tension spring that assists with returning the chair 10 to the upright position. In other embodiments, a compression spring is used where the spring boss 126 and the spring retainer 166 are switched between the first cover 46 and the lower portion 142. In still other embodiments, torsion springs are additionally or alternatively applied at the first or second pivot points P1, P2, for example, to assist with returning the chair 10 to the upright position.

Various modifications and additions can be made to the embodiments expressly discussed. For example, FIG. 15 shows a chair 300 substantially similar to the chair 10, according to some embodiments, though the chair 300 is shown without armrests and, rather than a base with casters, a base without casters.

Figure 16:
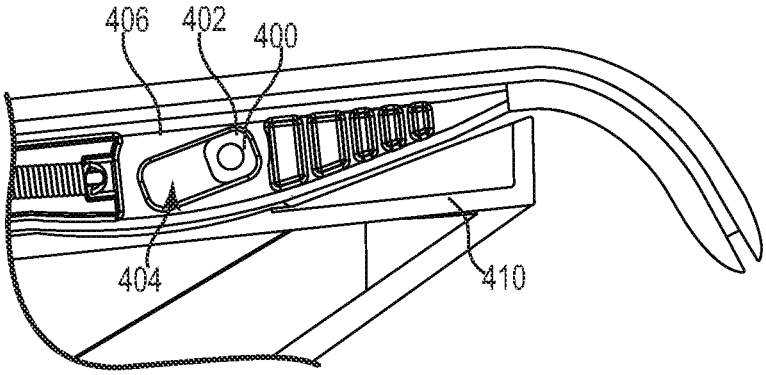
FIG. 16 shows another means for raising lower portions of lateral members vertically as upper portions of the lateral members are pivoted backward.

As another example, FIG. 16 shows another means for raising lower portions of lateral members vertically as upper portions of the lateral members are pivoted backward. In particular, FIG. 16 shows a post 400 maintaining a bushing 402 and an angled slot 404 formed into a lateral member 406 (e.g., similar to the first lateral member 130). The post 400 is connected to a first side mount 410 (e.g., similar to the first side mount 42). As the lateral member 406 moves forward, the slot 404 rides on the bushing 402 moving the lateral member 406 upward.

Figure 17:
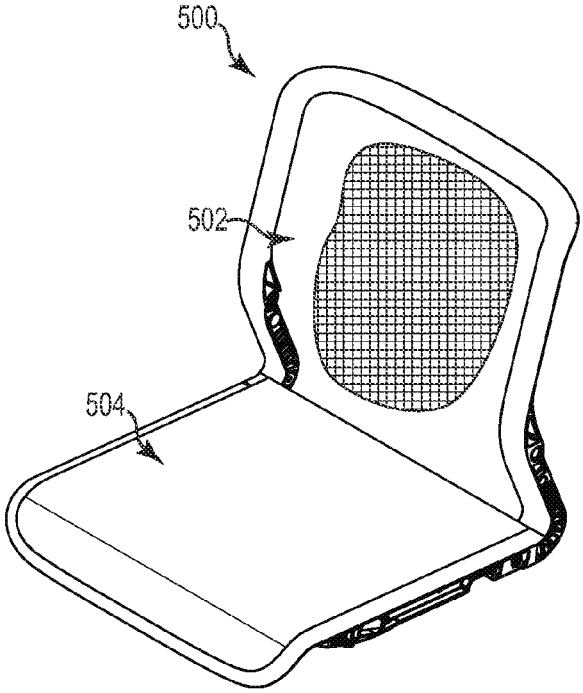
FIG. 17 shows another chair with a seating member including a mesh upper portion and a solid lower portion, according to some embodiments.
Figure 18:
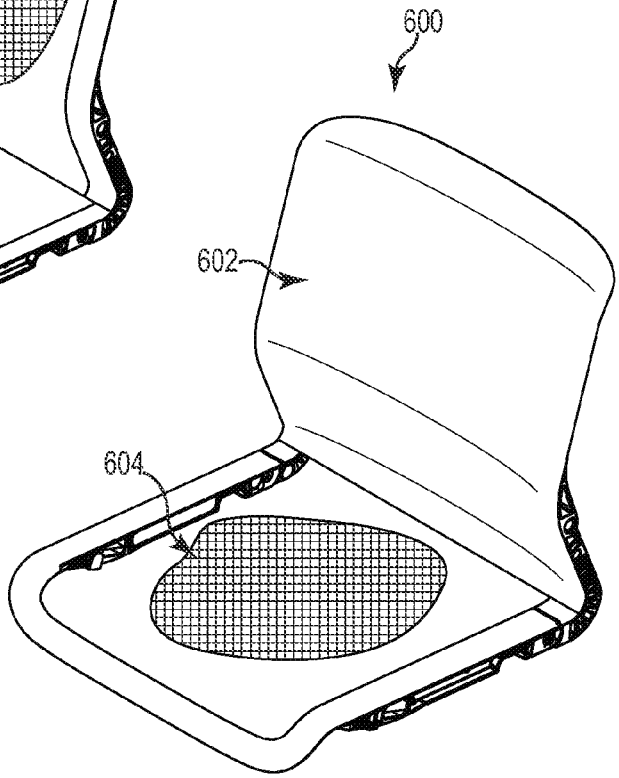
FIG. 18 shows another chair with a seating member including a mesh lower portion and a solid upper portion, according to some embodiments.
Figure 19:
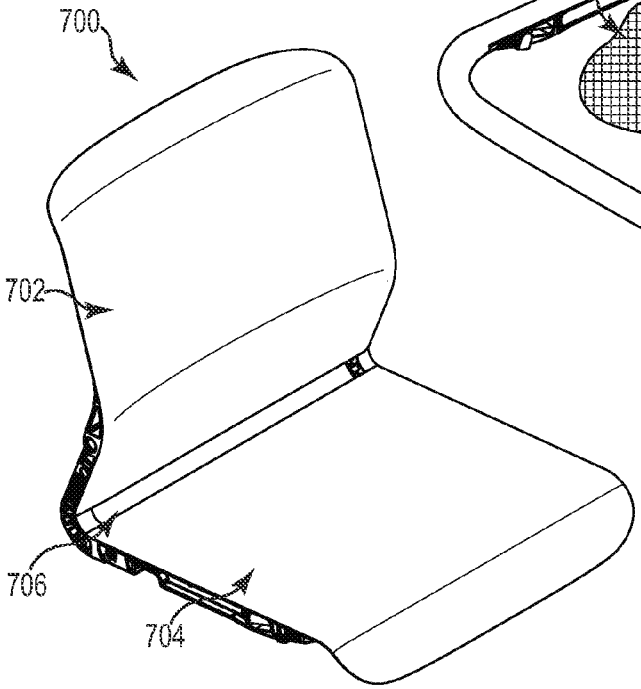
FIG. 19 shows another chair with a seating member including a solid upper portion and a solid lower portion with a gap between the upper and lower portions to facilitate pivoting/tilting between the upper and lower potions, according to some embodiments.

As still other examples, FIGS. 17 through 19 illustrate chair embodiments with a variety of seating member configurations. FIG. 17 shows a chair 500 with a seating member including a mesh upper portion 502 (e.g., secured between upper portions of corresponding lateral members) and a solid lower portion 504 (e.g., integrally formed with lower portions of the lateral members), according to some embodiments. FIG. 18 shows a chair 600 with a seating member including a mesh lower portion 604 (e.g., secured between lower portions of corresponding lateral members) and a solid upper portion 602 (e.g., integrally formed with upper portions of the lateral members), according to some embodiments. FIG. 19 shows a chair 700 with a seating member including a solid upper portion 702 (e.g., integrally formed with upper portions of corresponding lateral members) and a solid lower portion 704 (e.g., integrally formed with lower portions of the lateral members) with a gap 706 between the upper and lower portions 702, 704 to facilitate pivoting/tilting between the upper and lower potions 702, 704, according to some embodiments. In other embodiments, the gap 706 is replaced and/or augmented with a flexible material to facilitate relative movement between the upper and lower portions 702, 704.

As previously referenced, various modifications and additions can be made to the embodiments discussed without departing from the scope of the present invention. Moreover, while the embodiments described above refer to particular features, the scope of this invention also includes embodiments having different combinations of features and embodiments that do not include all of the above described features.

The following is claimed:

1. A chair comprising:

a base configured to support the chair on a surface;

a hub supported by the base and including:

a first side mount positioned on a first side of the chair, the first side mount including a back portion and a bottom portion, a first cover coupled to the first side mount to define a first channel with the first side mount, a second side mount positioned on a second side of the chair, the second side mount including a back portion and a bottom portion, and a second cover coupled to the second side mount to define a second channel with the second side mount; and a seat frame including:

a first lateral member including a lower portion and an upper portion that is pivotally coupled to the back portion of the first side mount and is configured to angulate relative to the lower portion, the lower portion of the first lateral member being slidably received in the first channel such that two sides and a bottom of the lower portion received within the first channel are substantially hidden from view, and a second lateral member including a lower portion and an upper portion that is pivotally coupled to the back portion of the second side mount and is configured to angulate relative to the lower portion, the lower portion of the second lateral member being slidably received in the second channel such that two sides and a bottom of the lower portion received within the second channel are substantially hidden from view.

2. The chair of claim 1, wherein the upper and lower portions of the first lateral member are pivotally coupled.

3. The chair of claim 2, wherein the upper and lower portions of the first lateral member are pivotally coupled at a location generally corresponding to a position underneath a hip joint of a user.

4. The chair of claim 1, wherein the upper and lower portions of the first lateral member are flexibly coupled.

5. The chair of claim 1, wherein the first side mount defines a substantially L-shaped side profile.

6. The chair of claim 1, wherein the back and bottom portions of the first side mount define an acute angle with one another in side profile.

7. The chair of claim 1, wherein a bottom portion of the first channel defines a slide surface and the lower portion of the first lateral member has a bushing that rests on top of the slide surface to be slidably received against the slide surface.

8. The chair of claim 7, wherein the slide surface is configured such that when the upper portion of the first lateral member is pivoted backward relative to the back portion of the first side mount, the lower portion of the first lateral member slides forward and is raised vertically on the first slide surface.

9. The chair of claim 1, wherein the seat frame further includes a front cross member coupling the lower portions of the first and second lateral members together and a back cross member coupling the upper portions of the first and second lateral members together, the back cross member, the front cross member, the first lateral member, and the second lateral member, combining to define an open center.

10. The chair of claim 9, further comprising an elastic mesh coupled directly to the first and second lateral members, the elastic mesh being held under tension between the first and second lateral members to support a user's weight.

11. The chair of claim 10, wherein the first lateral member, the second lateral member, the upper cross mount, and the lower cross mount are configured to resist a compressive force exerted by the mesh on the seat frame.

12. The chair of claim 1, further comprising an elastic seat member secured under tension between the first and second lateral members, the first and second side mounts supporting the first and second lateral members against a compressive force exerted by the elastic seat member on the first and second lateral members.

13. The chair of claim 1, further comprising a seat member that is integrally formed with the upper portions of the first and second lateral members.

14. The chair of claim 1, further comprising a seat member that is integrally formed with the lower portions of the first and second lateral members.

15. The chair of claim 1, wherein the upper and lower portions of the first and second lateral members are each substantially inflexible, molded, polymeric components.

16. The chair of claim 1, further comprising a spring secured between the lower portion of the first lateral member and the first side mount.

17. The chair of claim 1, further comprising a torsion spring secured between the upper portion of the first lateral member and the first side mount.

18. The chair of claim 1, further comprising a torsion spring secured between the upper and lower portions of the first lateral member.

19. A chair comprising:

a base configured to support the chair on a surface;

a hub supported by the base and including:

a first side mount positioned on a first side of the chair and having a back portion that extends substantially vertically and a bottom portion that extends substantially horizontally and defines a first channel, a second side mount positioned on a second side of the chair and having a back portion that extends substantially vertically and a bottom portion that extends substantially horizontally and defines a second channel, and a seat frame including:

a first lateral member including a lower portion and an upper portion coupled to the lower portion such that lower portion and the upper portion are configured for angulation relative to one another, the upper portion of the first lateral member being pivotally coupled to the first side mount at a fixed pivot and the lower portion of the first lateral member being slidably received in the first channel, the first channel defining a slide surface and the lower portion of the first lateral member having a bushing slidably received against the slide surface such that the lower portion of the first lateral member is raised vertically as the upper portion of the first lateral member is pivoted backward relative to the first side mount about the fixed pivot, and a second lateral member including a lower portion and an upper portion coupled to the lower portion such that lower portion and the upper portion are configured for angulation relative to one another, the lower portion of the second lateral member being slidably received in the second channel.

20. A chair comprising:

a base configured to support the chair on a surface;

a hub supported by the base and including:

a first side mount positioned on a first side of the chair and having a back portion that extends substantially vertically and a bottom portion that extends substantially horizontally and defines a first channel, a second side mount positioned on a second side of the chair and having a back portion that extends substantially vertically and a bottom portion that extends substantially horizontally and defines a second channel, a seat frame including:

a first lateral member including a lower portion and an upper portion coupled to the lower portion such that lower portion and the upper portion are configured for angulation relative to one another, the lower portion of the first lateral member being slidably received in the first channel, and a second lateral member including a lower portion and an upper portion coupled to the lower portion such that lower portion and the upper portion are configured for angulation relative to one another, the lower portion of the second lateral member being slidably received in the second channel, means for raising the lower portions of the first and second lateral members vertically as the upper portion of the first lateral member is pivoted backward about a fixed pivot location relative to the back portion of the first side mount; and means for supporting a user's weight between the first and second lateral members.

21. The chair of claim 20, wherein the means for raising includes a slide surface and a bushing slidably received against the slide surface.

22. The chair of claim 21, wherein the bushing is coupled to the lower portion of the first lateral member.

23. The chair of claim 20, wherein the means for raising includes a slot formed into the lower portion of the first lateral member and a rider coupled to the bottom portion of the first side mount, the rider being slidably received in the slot.

24. The chair of claim 20, wherein the means for supporting includes a mesh stretched between the first and second lateral members.

25. The chair of claim 20, wherein the means for supporting includes a seat secured between the first and second lateral members and a backrest secured between the first and second lateral members.

* * * * *